US006328115B1

(12) United States Patent
Carter, Jr.

(10) Patent No.: US 6,328,115 B1
(45) Date of Patent: Dec. 11, 2001

(54) STABILIZER FOR DIRT SCRAPER

(76) Inventor: Jimmy Carter, Jr., 12905 Philips Highway, Jacksonville, FL (US) 32256

( * ) Notice: Subject to any disclaimer, the term of this patent is extended or adjusted under 35 U.S.C. 154(b) by 0 days.

(21) Appl. No.: 09/643,816

(22) Filed: Aug. 22, 2000

(51) Int. Cl.[7] ..... E02F 3/76
(52) U.S. Cl. ..... 172/799.5; 172/197; 172/199
(58) Field of Search ..... 172/197, 199, 172/799.5

(56) References Cited

U.S. PATENT DOCUMENTS 1,968,412 7/1934 Lull .
4,389,800 6/1983 Goby .
5,307,570 5/1994 Brown .

*Primary Examiner*—Christopher J. Novosad
(74) *Attorney, Agent, or Firm*—Thomas C. Saitta

(57) ABSTRACT

A wheeled dirt scraper having a pair of stabilizer rails pivotally mounted onto each of the side wings of the box, the rails being provided with damping devices to reduce, absorb and eliminate shock effects. The rails have a relatively large surface contact area and extend substantially the length of the wings. The rails are mounted such that the lower surfaces can pivot below or even with the bottom edges of the wings, so that the rails can remain in contact with the ground even when the wings are suspended above the ground.

18 Claims, 3 Drawing Sheets

STABILIZER FOR DIRT SCRAPER

BACKGROUND OF THE INVENTION

This invention relates generally to the field of mobile equipment used to move or remove dirt and to level ground surfaces over relatively large areas, and more particularly to such equipment which are wheeled constructions pulled behind motorized vehicles, such being commonly referred to as dirt scrapers, box blades, box scrapers, pull-behind scrapers, levelers or the like. More particularly, the invention relates to such equipment which are provided with stabilizer means to reduce negative effects caused by uneven terrain, these negative effects known by such terms as bounce, walking or rocking, where the stabilizer means is damped to reduce vertical motion.

Dirt scrapers are used to remove large quantities of dirt in a relatively rapid manner and/or to level large areas of ground with relatively high precision. The scrapers are wheeled apparatuses having a large laterally extending scraping or cutting blade which shaves off raised areas of ground, the loose or removed dirt being retained within a box structure comprising lateral wings and a curved back panel. Loose dirt is deposited into depressions as the box is pulled along, such that the combination of dirt removal from the raised areas and the dirt deposition into the depressed areas produces a level surface. It is most important that the cutting blade be maintained in a horizontal position to insure a level scrape, but unevenness in the terrain and the speed of the operation combine to produce negative effects known as bouncing, walking or rocking, where the sides of the box and therefore the blade move up and down simultaneously or in alternating fashion, such that the blade alternately cuts too low and then not low enough to produce a level surface. Because of this bounce effect, scraping is usually performed at a very slow pace until a sufficient amount of dirt is accumulated in the box to preclude the problem—the weight or mass of the accumulated dirt tending to negate or diminish the bounce effect. When leveling large areas, maintaining this extremely slow pace is time-consuming and costly in terms of man-hour expenses, so it is highly desirable to correct the bounce effect problem in a manner which allows the box scraper to be pulled at a much higher speed during the leveling operation.

Prior attempts to address this problem include mounting fixed skid shoes or skid plates to the box, the tongue or the wheel suspensions of the scrapers, the skid shoes or plates providing additional contact points with the surface, but this adaption has been shown to reduce the negative effects only slightly. An improved approach has been to provide the skid shoes with damping means, such as springs or shock absorbing pistons, but the configuration and location of the shoes has not been optimized. Examples of such apparatuses are shown in U.S. Pat. No. 5,307,570 to Brown, U.S. Pat. No. 5,072,531 to Pronovost et al., U.S. Pat. No. 4,389,800 to Goby, U.S. Pat. No. 4,125,950 to Mashford, and U.S. Pat. No. 1,968,412 to Lull. The prior art typically teaches the use of skid shoes of relatively small surface area, with the skid shoes located to the rear of the cutting blade.

It is an object of this invention to provide a stabilizing means for dirt scrapers which alleviates the problem of bounce, by providing a pair of stabilizing rails of relatively large surface contact area, where the rails are mounted in a pivoting manner, laterally external to the side wings of the box, such that the rails extend along the base of the wings. The stabilizing rails are provided with damping means, such as shock absorbing pistons, to reduce shocks encountered during the leveling operation, thereby limiting or eliminating the negative bounce effects, enabling the scraper to be pulled at a much higher speed than normally available. Upward travel limiting means are also provided such that the amount of upward movement of the stabilizer rails can be controlled in order to maintain the lower surface of the rails at a desired height relative to the cutting blade. Furthermore, the stabilizing rails act to maintain the loose dirt within the box by precluding lateral movement of the removed dirt out from under the wings when they are slightly off the ground surface, thus preventing the formation of wind rows—a pair of raised ridges of loose dirt laid down on either side of the box portion of the scraper paralleling the direction of travel. These and other objects not expressed at this time are to be accomplished as described below.

SUMMARY OF THE INVENTION

The invention comprises in general an improvement to a dirt scraper apparatus used for leveling or removing dirt from large areas, such as the type comprising a dirt-controlling box with a curved mold board or back member, a pair of lateral wing members and a cutting blade suspended below the mold board, where the box is mounted in a cantilevered fashion between a set of rearwardly positioned wheels and a tongue and hitch combination for securing the apparatus to a motorized towing vehicle, such as a tractor. Height adjusting means, typically a hydraulically controlled piston, alters the position of the box relative to the ground between a passive, non-working position with the blade fully raised and an active, working position with the blade lowered, such that when the apparatus is pulled across terrain, any dirt encountered by the blade will be scraped from the surface and pushed along within the box.

The improvement is the provision of stabilizing means which comprise a pair of laterally disposed, relatively elongated, stabilizer rails or bars mounted externally to the wings of the apparatus. The rails are relatively wide laterally and have a preferably planar lower surface with a relatively large surface area in comparison to the width and surface area of the bottom edges of the wings. The stabilizer rails are connected to the wings in a pivoting manner, preferably with the pivot positioned toward the front of the apparatus, such that the stabilizer rails are able to move in the vertical direction independently of the wings. The stabilizer rails are mounted onto the wings such that the lower surfaces of the stabilizer bars are able to extend beneath the bottom edges of the wings and beneath the blade. Damping means, preferably a piston connected near the rear of each stabilizer rail, absorb shocks, dampen upward movement and allow the lower surfaces of the rails to float across the uneven ground surface as the apparatus is pulled forward. A retention member, such as a chain, limits travel of the stabilizer rails in the downward direction.

Preferably the stabilizer means are also provided with upward travel limiting means, such that the rails are prevented from upward movement relative to the wings past a predetermined point. Most preferably the limiting means is adjustable, such as a threaded bolt mounted into a flange on each of the wings, so that the amount of allowable upward travel can be changed as desired, effectively adjusting the cutting edge depth.

The stabilizer rails serve several functions, the primary of which is to restrict, limit or preclude rocking or bounce of the box of the apparatus, thereby allowing the apparatus to be pulled across the ground at a faster pace, since the rails remain in contact with the ground and the damping means limits the negative effects of asymmetric terrain and the inherent spring or bounce of the tires. Secondarily, the rails prevent lateral loss of removed dirt when the bottom edges of the wings are not in contact with the ground surface, since the lower surfaces of the rails extend beneath the bottom edges of the wings to remain in contact with the ground. Further, in conjunction with the upward travel limiting means, the stabilizer rails can be used to maintain the blade a minimum distance above the ground in a more controlled manner than can be achieved by using the height adjusting means of the dirt scraper apparatus itself, since the upward travel limit of the rails relative to the wings can be preset.

DETAILED DESCRIPTION OF THE INVENTION

With reference to the drawings, the invention will now be described in detail with regard for the best mode and the preferred embodiment. The invention is in general described as an improvement for a dirt scraper apparatus or an improved dirt scraper apparatus, the improvement comprising laterally-mounted stabilizer means for reducing bounce, walking or lateral rocking of the dirt scraper as it is pulled across terrain. For purposes of the disclosure, references to the forward direction shall be taken to refer to the direction of travel when the apparatus is being pulled by a motorized vehicle, the longitudinal direction shall be the direction generally parallel to the forward direction, and the lateral direction shall be the direction generally perpendicular to the longitudinal direction.

Figure 1:
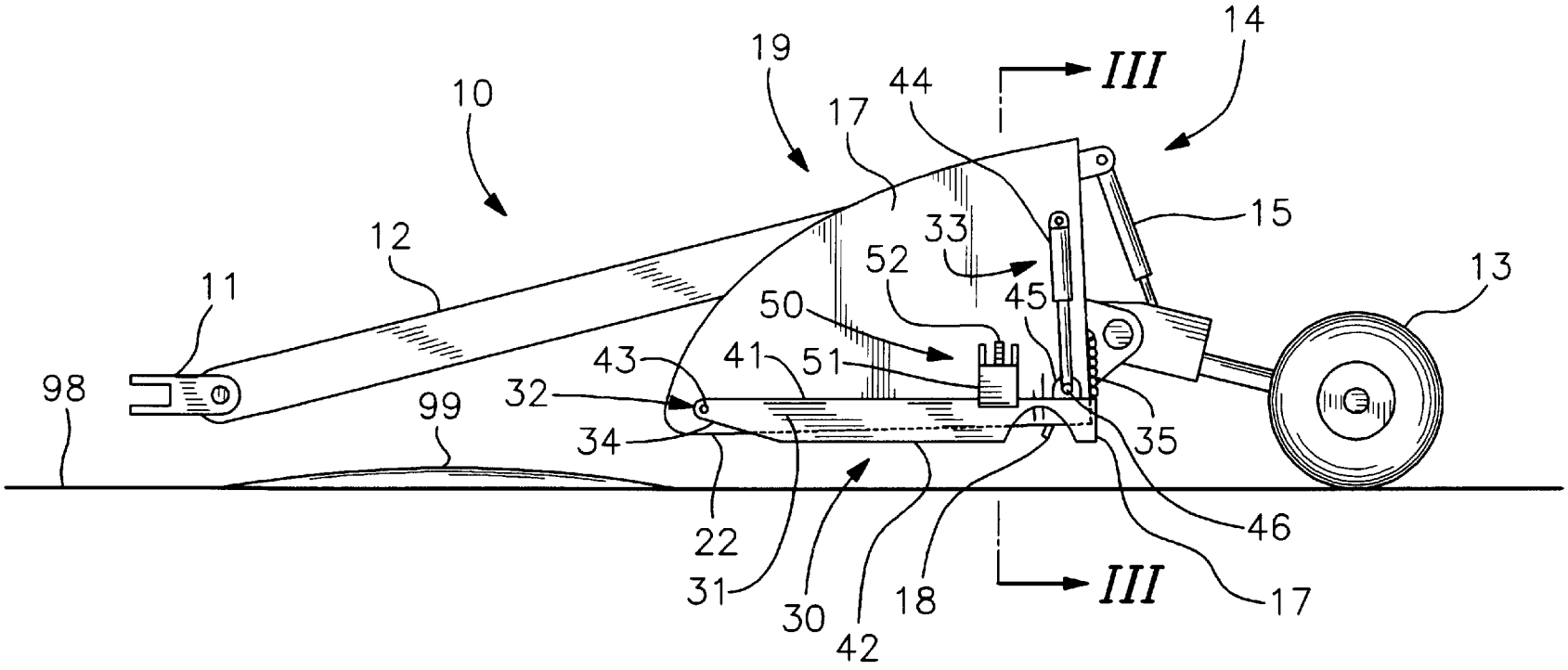
FIG. 1 is a side view of a dirt scraper showing the invention, with the scraper in the passive or raised position.
Figure 2:
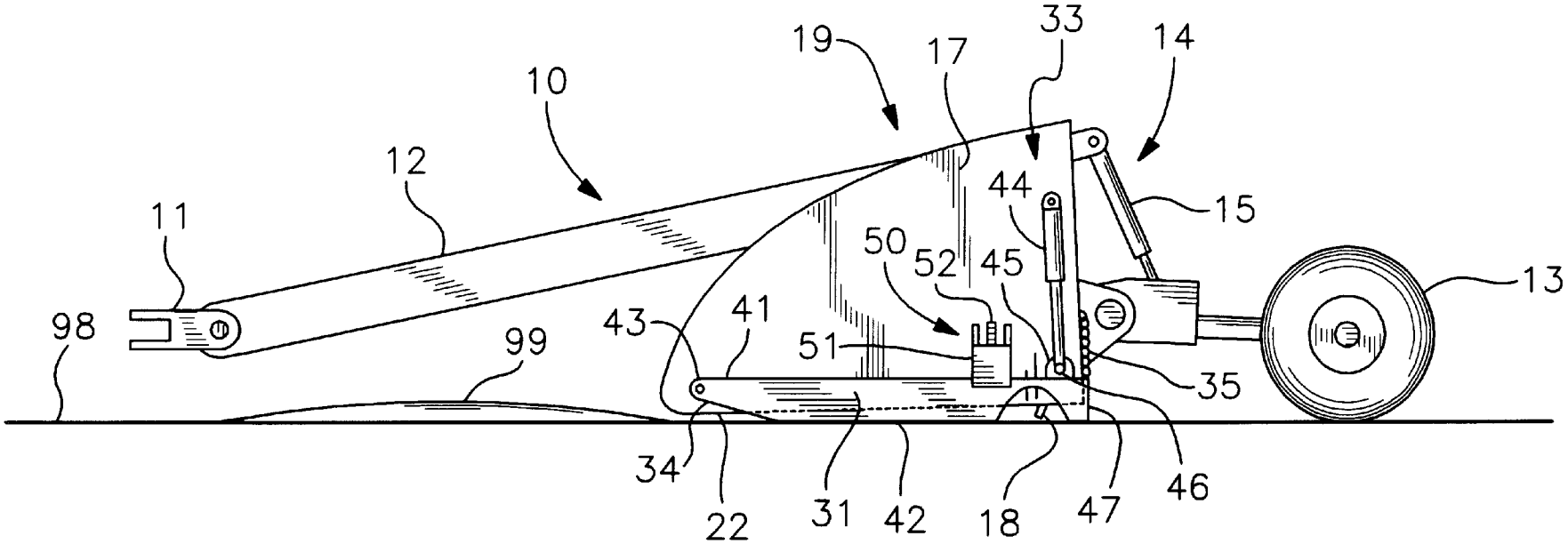
FIG. 2 is a side view of a dirt scraper showing the invention, with the scraper in the active or lowered position.

A typical configuration for a dirt scraper apparatus, also known in the industry as grading scrapers, box scrapers, box blades, pull scrapers, pull pans, straight blade finishing scrapers, land leveling scrapers and the like, is shown in FIGS. 1 and 2. The dirt scraper 10 is an apparatus designed to be towed by a tractor or other motorized vehicle (not shown), and as such is provided at its forward end with an extended tongue member 12 and a hitch member 11 for attachment to the vehicle itself. A set of wheels 13 is located to the rear of the apparatus, and a ground handling box member 19 is disposed forward of the wheels 13, the box member 19 retaining the loose dirt removed as the apparatus is pulled across uneven terrain. The box member 19 is comprised of a pair of lateral, upstanding wing members 17 having bottom edges 22, which are joined together across the rear of each by a mold board or back panel member 16, the mold board 16 being curved such that it is concave on its forward side. A laterally extending blade member 18 is disposed along and positioned to extend beneath the bottom edge 21 of the mold board 16, with the blade 18 running substantially the full distance between the wings 17. The scraper 10 is provided with height adjusting means 14 such that the box member 19 and blade 18 can be raised up into a passive, non-functioning position to allow transport of the scraper 10 (as shown in FIG. 1), and alternatively lowered into an active or functioning position when the scraper 10 is in use (as shown in FIG. 2). Typically, the height adjusting means 14 comprises joining the tongue 12 to the wheels 13 in a cantilevered manner and providing a hydraulic piston 15 to alter the relative angle between the forward and rearward components, thereby raising or lowering the intermediate box member 19. With the box member 19 and blade 18 lowered into the active position, the scraper 10 is pulled across the ground 98 such that any raised or elevated ground portions 99 contacted by the blade 18 have a layer of dirt removed. This removed dirt remains trapped within the box member 19, such that a significant volume of dirt can be removed before the box member 19 must be emptied. Correspondingly, if the scraper 10 is pulled across areas having depressions, loose dirt in the box member 19 will drop down to fill the depression, with the final result that large surface areas can be leveled in a relatively quick fashion. Such constructions and operating functions for dirt scrapers 10 are well known in the industry.

Because the box member 19 is suspended between the towing vehicle and the wheels 13, because the scraper 10 is relatively wide so that a large area can be leveled with every pass of the apparatus, and because the height of the blade 18 relative to the ground 98 is often set such that the bottom edges 22 of the lateral wings 17 do not continuously contact the ground 98, and even when in contact do not present much contact surface area because of their relatively thin width dimension, the box member 19 when it is pulled too fast often begins rocking, walking or bouncing because of the uneven terrain, which results in undesirable movement of the blade 18 such that a level scraping is not achieved, the ground is chopped and removed dirt is lost from the box member 19. Dirt scrapers 10 of conventional design must therefore be pulled fairly slowly across terrain in order to prevent rocking and bouncing.

The improvement comprises the provision of stabilizer means 30 which effectively counter, limit or preclude rocking and bounce, enabling the scraper 10 to be pulled across the ground 98 at a much faster rate, typically about twice the standard speed of from six to eight mph. The stabilizer means 30 comprise a pair of longitudinally elongated stabilizer rail or bar members 31 which are laterally mounted externally to the wings 17, preferably relatively adjacent to the wings 17. The stabilizer rails 31 preferably have a generally planar lower surface 42, but may be curved or arched, extend longitudinally substantially the full length of the wings 17 and are several inches in width laterally across the lower surface 42, such that a relatively large contact surface area or footprint is provided, especially in comparison to the contact surface area of the bottom edges 21 of the wings 17, which are usually less than about one inch in width. The stabilizer rails 31 are preferably generally square or rectangular in cross-section and provided with a rounded, slanted or sloping leading edge 34 along the forward portion of the lower surface 41. The stabilizer rails 31 are pivotally connected to the wings 17, preferably at the forward ends of the rails 31 and wings 17 adjacent the leading edges 34, by pivot attachment means 32, such as a pin, rod or bolt 43 positioned in an aperture in the stabilizer rails 31 in conventional manner, such that the stabilizer rails 31 can pivot in the vertical direction independently of the wings 17. The free end 47 of each of the stabilizer rails 31 is suspended from the wings 17 or the mold board 16 by a retention member 35, such as a chain or cable, which limits the amount of travel in the downward direction and maintains the stabilizer rails 31 in a lifted state when the scraper 10 is not in use and in the raised position. The rails 31 are mounted such that the lower rail surfaces 42 may pivot to positions either below or even with the bottom edges 22 of the wings 17.

Damping means 33 are provided to slow or damp the rate of vertical travel of the stabilizing rails 31, thereby absorbing and reducing the effects of bumps, shocks or the like encountered on the ground surface 98, as well as the effects from one side of the blade member 18 gouging the ground, which in turns places an excessive load on the wheels 13 on one side, causing them to rebound to make the problem worse. As shown in the drawings, the damping means 33 preferably comprise a pair of pistons or shock absorbers 44, preferably adjustable relative to their damping strength, connected to the wings 17 and the upper surfaces 41 of the rear portions of the stabilizer rails 31, being attached to the stabilizer rails 31 by piston mounting flanges 45 and mounting pins 46. Equivalent structures can be utilized for the damping means 33, such as springs. By damping the effects of bumps and uneven terrain on the stabilizer rails 31, the negative effects which would normally result in bounce or rocking of the box 19 are minimized and mitigated. Locating the stabilizer rails 31 on the exterior sides of the wings 17 and structuring the stabilizer rails 31 to have a lower surface of relatively large dimensions provides the most effective counter-effect to the uneven terrain. This construction also serves to provide additional lateral barriers against losses of the removed dirt contained within the box member 19 when the bottom edges 22 of the wings 17 are disposed above the ground surface 98, a condition which leads to the creation of wind rows.

Figure 3:
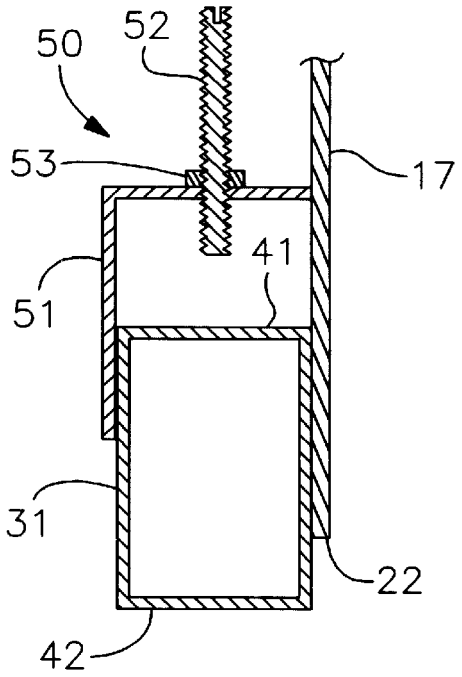
FIG. 3 is a cross-sectional view of the invention taken along line III—III of FIG. 1, where the stabilizer rail is shown in the extended position relative to the wing.
Figure 4:
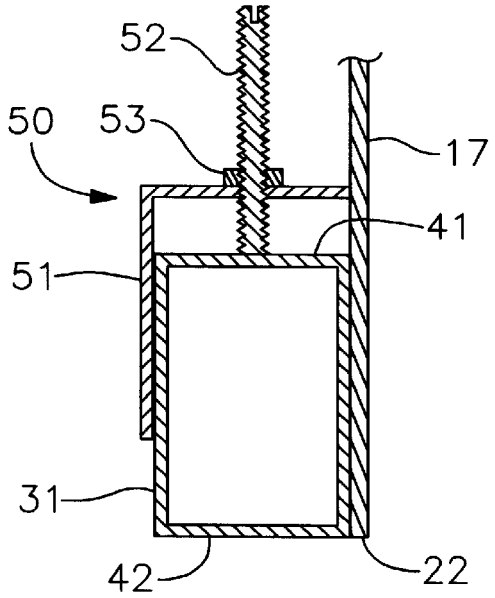
FIG. 4 is a cross-sectional view of the invention similar to FIG. 3, where the stabilizer rail is shown in the elevated position relative to the wing.
Figure 5:
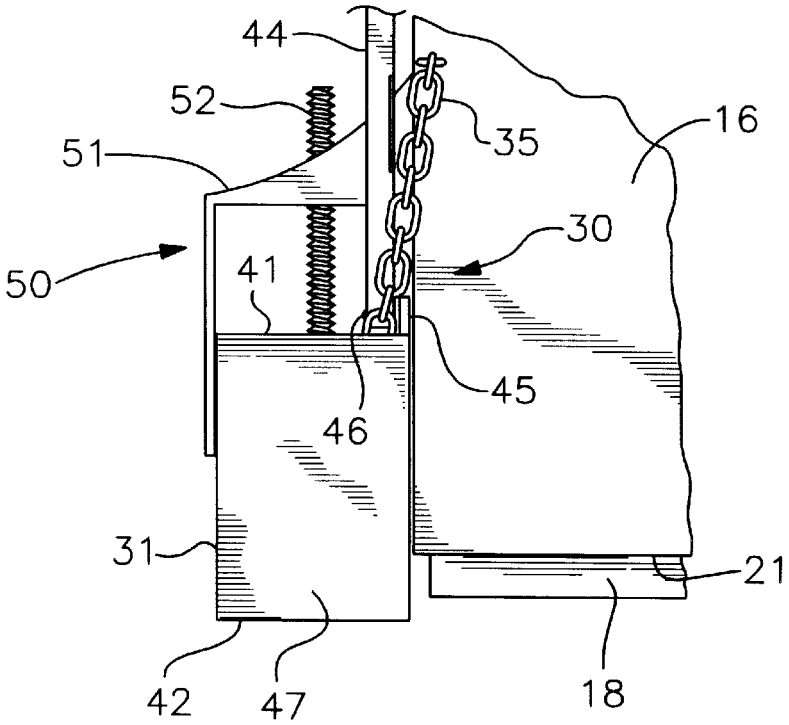
FIG. 5 is a rear view of the invention showing the blade depth limiting means positioned to restrict upward movement of the stabilizer bar beyond a preset upper limit.

In a more preferred embodiment, the dirt scraper apparatus 10 is provided with means 50 to limit the upward travel of the stabilizer rails 31, which is preferably adjustable such that the full range of vertical travel of the stabilizer rails 31 is controlled as desired. The upward travel limiting means 50 may comprise a generally L-shaped mounting flange 51 attached to the side of the wing 17 above the stabilizer rail 31, as seen best in FIGS. 3 through 5. The flange 51 is provided with a threaded flange nut 53 to receive an externally threaded wedge bolt 52, the wedge bolt 52 being adjustable vertically relative to the flange 51. In the working condition, the bolt 52 is retracted to allow upward movement of the stabilizing rail 31 when raised ground surfaces 98 are encountered, as shown in FIGS. 3 and 4, the upward movement from the lowermost position being damped by the damping means 33. In addition, the travel limiting means 50 can be set to preclude upward movement beyond a desired point, such as the point where the lower surface 42 of the stabilizing rail 31 is equal with the bottom surface 22 of the wing 17, as shown in FIG. 4, or to act as a means to maintain the cutting blade 18 a desired minimum distance above the ground 98, as shown in FIG. 5, such that even if the bottom edges 22 of the wings 17 are elevated above the ground 98, the box member 19 will remain stabilized and the blade 18 will remain horizontal because the stabilizer rails 31 will remain in contact with the ground 98. This construction allows the height of the blade 18 to be more finely controlled in comparison to setting the blade 18 height solely through the height adjusting means 14 cantilevering the tongue 12 and wheels 13.

It is contemplated that equivalents and substitutions for certain elements set forth above may be obvious to those skilled in the art, and thus the true scope and definition of the invention is to be as set forth in the following claims.

What is claimed is:

1. In a wheeled dirt scraper apparatus which is pulled behind a motorized vehicle to remove dirt from and level uneven terrain, the apparatus comprising a box member to retain loose dirt removed by the apparatus, the box member comprising a pair of generally upright lateral wing members bridged by a back panel member, the wing members each having a bottom edge and the back panel member having a bottom edge, with a generally horizontally disposed laterally extending blade member depending from the back panel member, the improvement comprising:

stabilizer means attached to said box member to reduce bounce effects caused by uneven terrain, said stabilizer means comprising a pair of longitudinally elongated stabilizer rail members, where one said stabilizer rail member is pivotally mounted to one of said wing members and the other of said stabilizer rail members is pivotally mounted to the other of said wing members, said stabilizer rail members being mounted externally and laterally to said wing members, where said stabilizer rail members can pivot in the vertical direction relative to said wing members, where said stabilizer rail members each comprise a lower surface having a ground contact surface area greater than the ground contact surface area of said lower edge of said wing member, and where said stabilizer rail members are mounted to said wing members such that said lower surfaces of said stabilizer rail members can be disposed even with or below said bottom edges of said wing members;

said stabilizer means further comprising damping means to damp the rate of vertical travel of said stabilizing rail members.

2. The improvement of claim 1, where said damping means comprises a shock absorbing piston attached between each of said stabilizer rail members and said wing members.

3. The improvement of claim 1, further comprising upward travel limiting means to limit the amount of upward movement by said stabilizer rail members relative to said wing members.

4. The improvement of claim 3, where said upward travel limiting means is adjustable to vary said amount of vertical movement.

5. The improvement of claim 4, where said upward travel limiting means comprises a pair of externally threaded wedge bolt each disposed within a mounting flange attached to one of said wing members.

6. The improvement of claim 1, where each of said stabilizing rail members has a leading edge, and where each said stabilizing rail member is pivotally mounted to said wing member adjacent said leading edge.

7. The improvement of claim 6, where each said leading edge is sloped.

8. The improvement of claim 1, where said stabilizer rail members extend substantially the full length of said wing members.

9. The improvement of claim 1, further comprising a retention member to limit the amount of downward travel by said stabilizer rail members relative to said wing members.

10. A wheeled dirt scraper apparatus which is pulled behind a motorized vehicle to remove dirt from and level uneven terrain, the apparatus comprising:

a box member to retain loose dirt removed by the apparatus, said box member comprising a pair of generally upright lateral wing members bridged by a back panel member, said wing members each having a bottom edge and said back panel member having a bottom edge, with a generally horizontally disposed laterally extending blade member depending from said back panel member;

stabilizer means attached to said box member to reduce bounce effects caused by uneven terrain, said stabilizer means comprising a pair of longitudinally elongated stabilizer rail members, where one said stabilizer rail member is pivotally mounted to one of said wing members and the other of said stabilizer rail members is pivotally mounted to the other of said wing members, said stabilizer rail members being mounted externally and laterally to said wing members, where said stabilizer rail members can pivot in the vertical direction relative to said wing members, where said stabilizer rail members each comprise a lower surface having a ground contact surface area greater than the ground contact surface area of said lower edge of said wing member, and where said stabilizer rail members are mounted to said wing members such that said lower surfaces of said stabilizer rail members can be disposed even with or below said bottom edges of said wing members;

said stabilizer means further comprising damping means to damp the rate of vertical travel of said stabilizing rail members.

11. The apparatus of claim 10, where said damping means comprises a shock absorbing piston attached between each of said stabilizer rail members and said wing members.

12. The apparatus of claim 10, further comprising upward travel limiting means to limit the amount of upward movement by said stabilizer rail members relative to said wing members.

13. The apparatus of claim 12, where said upward travel limiting means is adjustable to vary said amount of vertical movement.

14. The apparatus of claim 13, where said upward travel limiting means comprises a pair of externally threaded wedge bolt each disposed within a mounting flange attached to one of said wing members.

15. The apparatus of claim 10, where each of said stabilizing rail members has a leading edge, and where each said stabilizing rail member is pivotally mounted to said wing member adjacent said leading edge.

16. The apparatus of claim 15, where each said leading edge is sloped.

17. The apparatus of claim 10, where said stabilizer rail members extend substantially the full length of said wing members.

18. The apparatus of claim 10, further comprising a retention member to limit the amount of downward travel by said stabilizer rail members relative to said wing members.

* * * * *